US005238716A

United States Patent [19]

Adachi

[11] Patent Number: 5,238,716

[45] Date of Patent: Aug. 24, 1993

[54] COMPOSITE BEAM HAVING A HOLLOW CROSS SECTION

[76] Inventor: Yutaka Adachi, 77 Saskatoon Drive, Weston, Ontario, Canada, M9P 2G1

[21] Appl. No.: 732,908

[22] Filed: Jul. 19, 1991

[51] Int. Cl.[5] ..... E04C 3/28

[52] U.S. Cl. ..... 428/34.7; 428/36.3; 428/36.1; 428/36.91; 428/109; 428/113; 428/228; 428/246; 428/273; 428/301; 52/724; 52/725; 52/717; 212/266; 138/140

[58] Field of Search ..... 428/34.7, 36.3, 36.1, 428/36.91, 109, 113, 114; 52/902, 228, 246, 273, 301, 725, 727, 724, 731; 212/266; 138/140, 144, 145, 177

[56] References Cited

U.S. PATENT DOCUMENTS 3,992,836 11/1976 Mitra ..... 52/731
4,347,019 8/1982 Metz ..... 52/727
5,108,810 4/1992 Williams ..... 428/36.1

*Primary Examiner*—Ellis P. Robinson
*Assistant Examiner*—Charles R. Nold
*Attorney, Agent, or Firm*—Donald E. Hewson

[57] ABSTRACT

A composite beam having high compressive and tensile strength is disclosed. The beam is also very lightweight, has a high modulus of elasticity, and is able to support heavy loads in applications such as in use in aerial lift devices. High dielectric resistance is also a very important property exhibited by the beam. There are three structural layers in the beam including an inner layer comprising a wound filament, a middle layer comprising a plurality of plates, and an outer layer also comprising a woven or a non-woven material.

10 Claims, 7 Drawing Sheets

COMPOSITE BEAM HAVING A HOLLOW CROSS SECTION

FIELD OF THE INVENTION

This invention relates to light weight structural beams and more particularly to electrically insulative light weight structural beams of high mechanical and dielectric strengths. Even more particularly, the beam is for use in high load-bearing situations, with the load generally being applied at one end of the beam and with the beam being supported at the other end. A common use for such a beam is as part of an aerial lift device, supporting or lifting heavy equipment or a cage for carrying one or more persons.

BACKGROUND OF THE INVENTION

A common use for light weight high strength beams can be found in boom trucks—trucks that are used to lift a cage or similar containing a person and/or machinery to an elevated position. Such trucks may be employed in maintenance of buildings, high voltage wires, telephone wires, and the like, or in attending to trees, especially fruit trees, or a variety of other applications. In these boom trucks, it is important that the boom be as strong as possible so that a maximum amount of weight can be supported at the outer end thereof. It is also important that the boom be as long as possible, or at least as long as required, so that desired elevated positions can be reached.

It is also necessary that the beam be as strong as possible, but also be as light weight as possible in order not to add unnecessarily to the overall weight of the boom, since the beam must also support its own weight.

Such beams typically experience tensile stresses in their upper region and compressive stress in their lower region. Further, when the beams are subject to cantilever bending they also experience shear stresses in their side walls. Torsional load will also create additional shear stresses.

In order to construct a beam that can provide resistance to all these types of stresses, especially with these stresses being fairly high, and also provide a light enough weight beam, a composite material or materials are typically used. Further, such materials are typically formed into a beam by a multi-step method of manufacture.

Another very important characteristic of the beam is that it has an extremely high dielectric strength. The beam must be able to withstand a very high voltage applied thereto while allowing an electrical current that is in the order of a few microamperes to pass. Such an electrical condition can occur if the beam comes in contact with hydro wires. Indeed, it is necessary that the beam be able to withstand and insulate high electrical voltages in order to protect anyone working in a bucket suspended at the end of the boom. It is usual for workmen working on high voltage electrical power lines (in the order of up to several hundred thousand volts) to work on those lines live—that is, the lines are operating while being worked on.

It is therefore necessary that the material or materials used have a high dielectric strength. It is necessary that the beam not have any voids therein, to preclude the trapping of moisture. Having moisture trapped with the beam, whether in voids within the material, or in voids between material parts, could allow for electrical conductance, sufficient enough to make the beam unsafe.

The above mentioned properties of the beam are necessary in order for a boom truck using such a beam to be safe. The ultimate safety of the boom truck is also dependent on proper installation of the beam therein and subsequent safe use, so that the above mentioned properties of the beam are not comprised.

DESCRIPTION OF THE PRIOR ART

Reference will now be made to FIGS. 1 and 2 which show the prior art beam that is most similar to the invention described herein, has a hollow core with a glass filament winding wrapped therearound. The beam is formed by wrapping a resin soaked glass filament winding around a solid mandrel of generally square cross-section with rounded corners. The mandrel and the glass filament winding therearound are best shown in FIG. 1. The resin is then allowed to set, and the mandrel is removed thus leaving a hollow beam. The resulting beam is somewhat rounded around its perimeter, which is not acceptable in most cases.

In order to make the sides of the beam generally planar, the four sides are cut to a generally planar shape as shown in FIG. 2. Such cutting of the material is detrimental to the strength of the beam because the glass filament is not continuous but is merely many cut strands. The cross-section of the finished beam is shown in FIG. 2.

Further, it has been found that the prior art beam typically has a glass filament content in the range of about 65% by weight, which is less than a typical amount of 75% for the invention disclosed herein. Resultingly, this detracts from the strength and modulus of elasticity of the Prior Art beam.

SUMMARY OF THE INVENTION

The present invention provides a composite beam of high strength and of light weight that is suitable for use in aerial lift devices and the like. The beam is made of three distinct layers, an inner structural layer, a middle structural layer, and an outer structural layer. The inner structural layer comprises a glass filament winding that has been saturated in resin and subsequently cured, around a central hollow core. The middle structural layer comprises a set of four plates placed around the inner structural layer, with the four plates being composed of a cured resin material with glass fibre roving therein. The plates are pre-molded and cured prior to winding. The glass fibre roving is generally unidirectionally aligned along the plates. Around the middle structural layer is an outer structural layer that is comprised of layers of woven or non-woven fibre material that have been saturated with resin and thereafter cured. It may indeed be a chopped strand mat of fibreglass, which is non-woven. Alternatively, it may be a woven roving. Further, it may be any sort of similar woven or non-woven material.

The resin may be chosen from many types of polymer, and in preferably an epoxy, an unsaturated polyester or a vinylester.

The beam of the present invention also provides a beam having virtually no voids, either in the materials of between the various material parts. This lack of voids causes the beam to have very high compressive and tensile strength and also allows the beam to preclude the intrusion of moisture, which can drastically affect the dielectric strength. The beam of the present invention is highly resistant to electrical current flow and is able to withstand and insulate high electrical voltages.

BRIEF DESCRIPTION OF THE DRAWINGS

Embodiments of this invention will now be described by way of example in association with the accompanying drawings, in which.

DETAILED DESCRIPTION OF THE PREFERRED EMBODIMENTS

Figure 1:
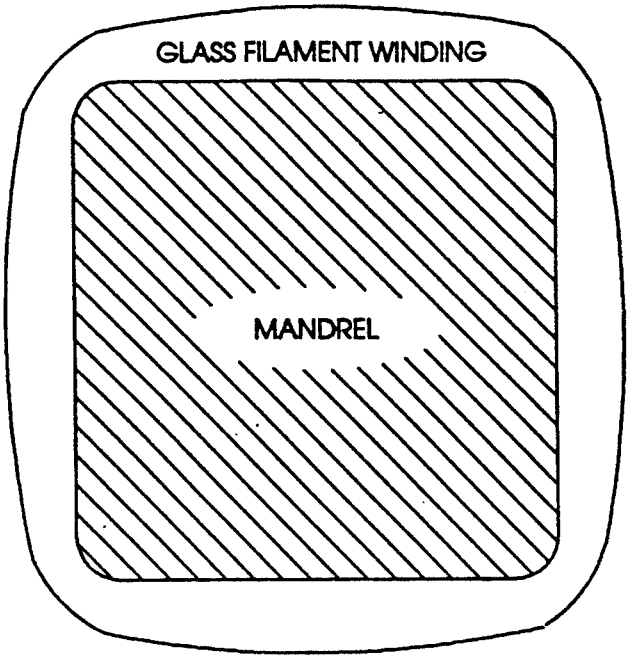
FIG. 1 PRIOR ART
FIG. 1 is a cross-sectional view of a prior art beam during manufacture.
Figure 2:
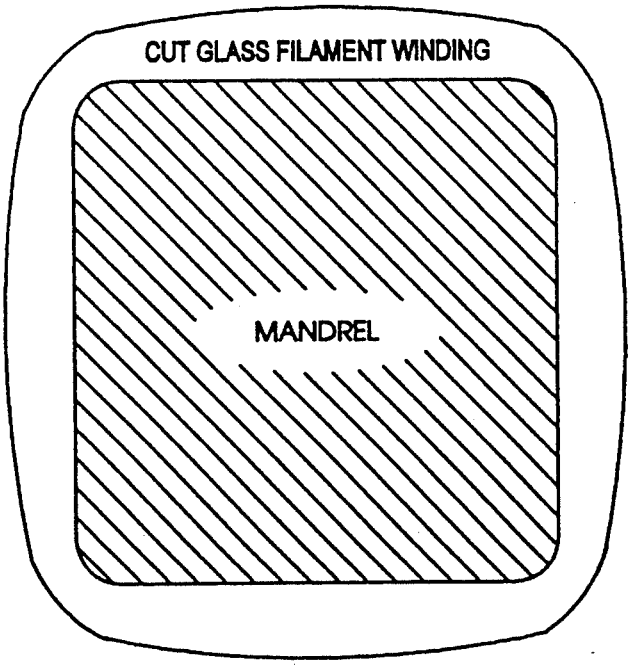
FIG. 2 PRIOR ART
FIG. 2 is a cross-sectional view of a prior art beam after the manufacturing process is complete.
Figure 3:
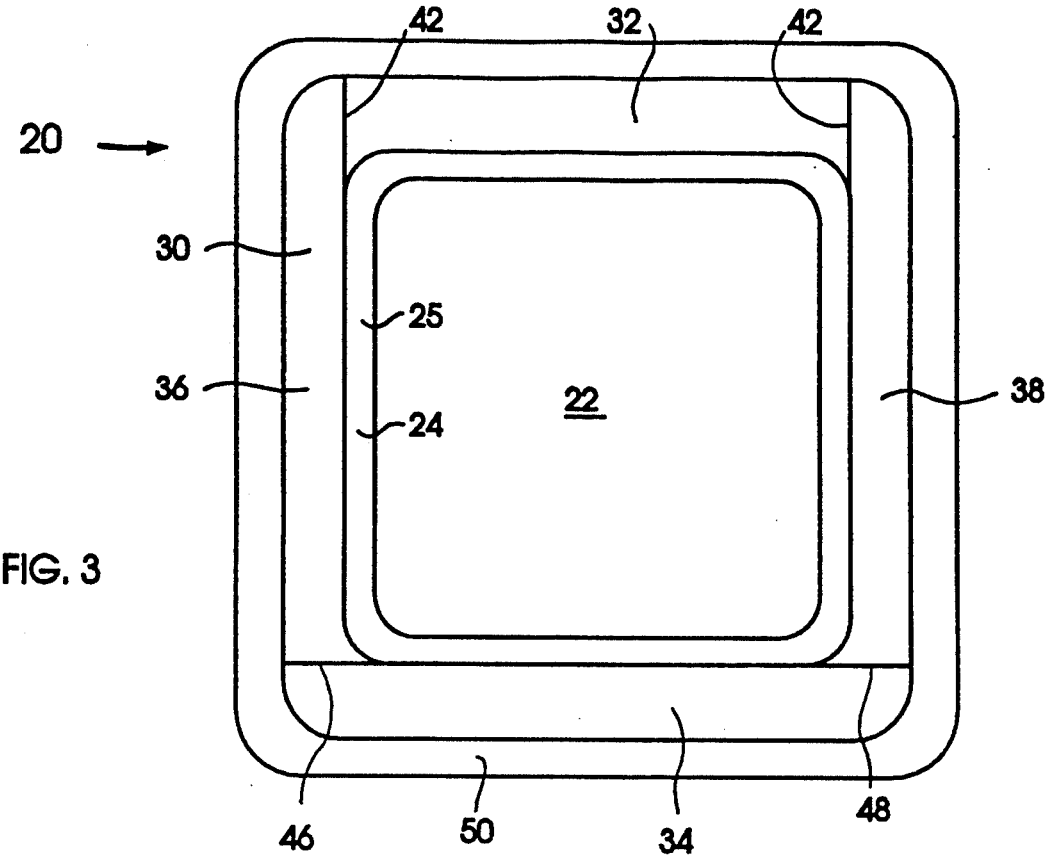
FIG. 3 is a cross-sectional view of the beam of the present invention.
Figure 4:
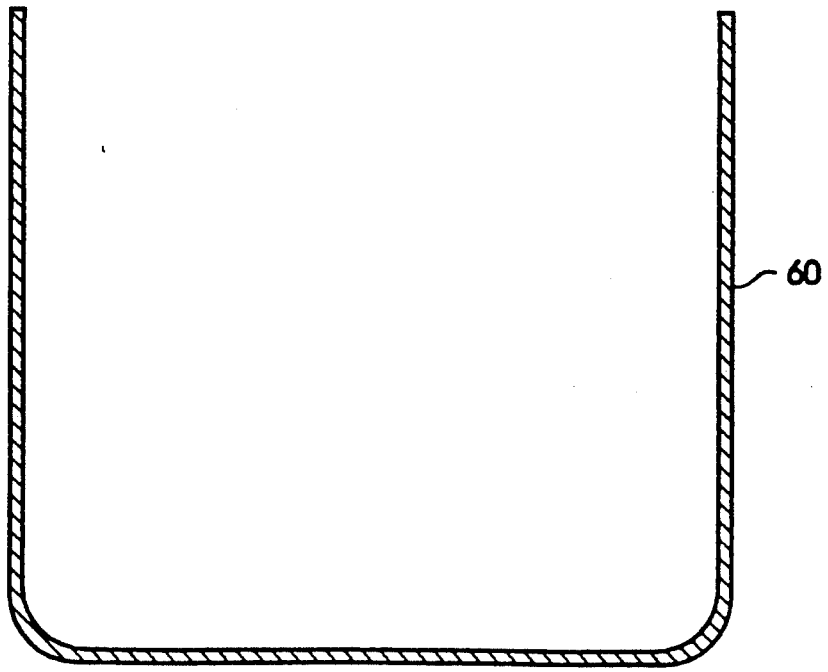
FIGS. 4 through 13 are cross-sectional views of the mold used to form the beam and the various components or the beam.
Figure 5:
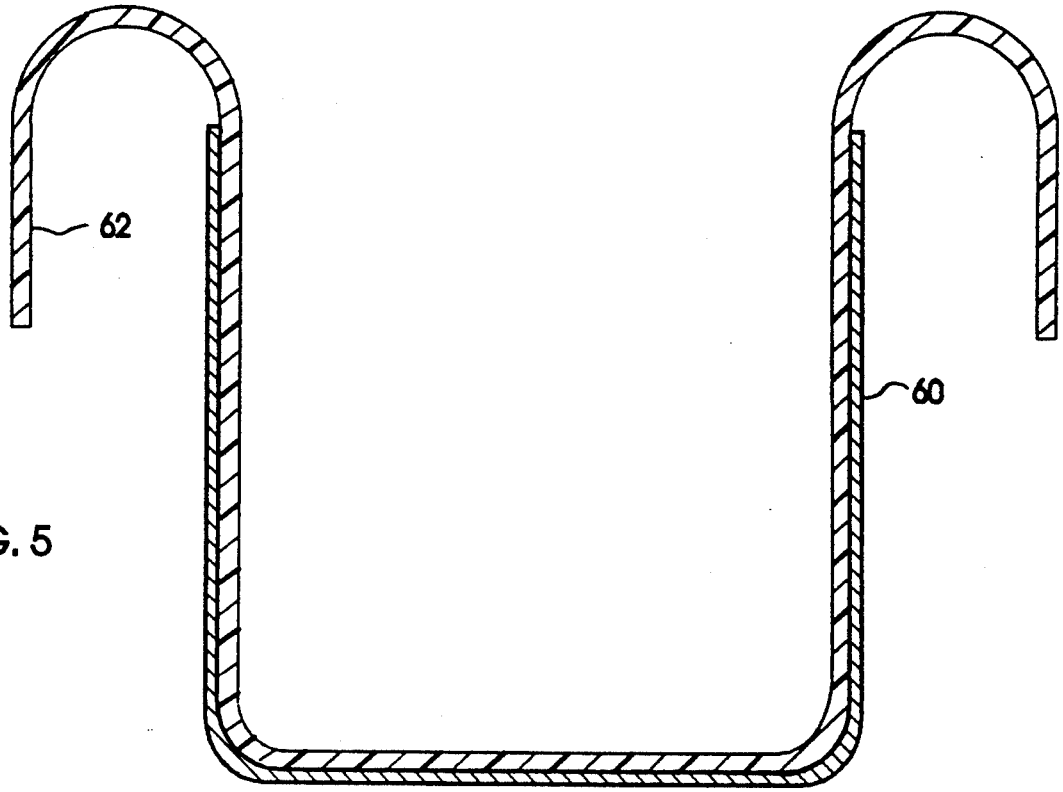

Reference will now be made to FIG. 3, which shows a beam 20 having a hollow core 22, an inner structural layer 24 around said core 22, a middle structural layer 30 around the inner structural layer 24, and an outer structural layer 50. It has been found that various thicknesses of these layers may be suitable depending on specific requirements. One example of these thicknesses is about ⅛" for the outer structural layer, ½" for the middle structural layer, and ⅛" for the inner structural layer. These thicknesses are fairly representative of typical sizes for these layers. Of course, these layers may be any thickness depending on the engineering requirements of the beam.

The inner structural layer 24 comprises a continuous filament wound in layers of continuous roving along the length of the beam 20 impregnated with resin and cured. The filament 25 is saturated with cured resin. The angle that the filament 25 is, measured with respect to the longitudinal axis of the beam, can be anywhere between 20° and about 85°. The angle used for the wound filament 25 within any particular beam depends on the required properties of the beam. It has been found that in order to resist hoop stress, the winding angle should be closer to the maximum angle of 85°. It has also been found that in order to resist longitudinal stress, the winding angle shall be closer to the minimum angle of 20°. It have been found that the ideal and for resisting twisting moment is 45°.

Around the inner structural layer 24 is a middle structural layer 30 that comprises a series of four pre-molded plates, a first plate 32, a second plate 34, a third plate 36, and a fourth plate 38. The first plate 32, which is generally considered the top plate, has edges 42 that are in intimate contact with portion of the side of the third and fourth plates 36, 38. The second plate 34, which is usually the bottom plate, is in intimate contact at portions of its side with one edge 46 of third plate 36 and with one edge 48 of fourth plate 38. Together, these four pates form the middle structural layer 30, with one side of each of these plates being in intimate contact with the inner structural layer 24.

The plates are pre-molded and composed of a cured resin material having a fibre roving, with the fibres being generally unidirectional and substantially aligned lengthwise along the plates. The plates are generally planar, but are shaped to some degree near their corners in order that the inner and outer surfaces formed by the four plates have rounded rather than squared corners, as viewed in cross-section. The plates must be designed to fit properly between the inner and outer structural layers and must full all of the space between the inner and outer structural layers. The cross-section shapes of the plates are predetermined depending on the shape of the inner and outer structural layers. As viewed in cross-section, the corners of the plates, may be square or radiused; the sides of the plates may be straight or curved.

Around the middle structural layer is an outer structural layer 50. This outer structural layer 50 comprises layers of a chopped strand mat or woven roving or a similar woven or non-woven fibre material, wrapped around the middle structural layer 30. The material is soaked in resin, which is subsequently cured.

The inner structural layer 24 and the outer structural layer 50 serve to encase and generally support the middle structural layer 40. Further, the inner and outer layers 24 and 50 add substantially to the torsional strength and to the shear strength of the beam 20.

The middle structural layer 30 provides the main component for resisting the compressive and tensile forces experienced by the beam while the beam is supporting a load. The resistance to these forces is quite high, which means the beam is of a very high strength, especially in terms of lifting loads at or near one end thereof while supported at the other.

A very important factor to be considered in safe beam design is the maximum bending moment of the beam. This maximum bending moment occurs at the fixed end of the beam. The maximum bending moment is in a typical case expressed as a product of the loading arm and the load at certain points along the beam. The loading arm "L" is defined as the distance between the fixed end of the beam and the application point of the load of weight "W". The maximum bending moment "M" is defined as $M = L \times \text{Weight} \times \text{Cosine } A$, where "A" is the angle between the beam and horizontal. This angle changes as a beam is raised or lowered. As a beam is raised, the angle "A" increases, which means that the bending moment is decreased.

Additionally, if the beam is also supporting a cable, the cable extending from a winch mounted at the support point of the beam to a pulley located on the loading end of the beam, the beam is also subjected to an additional compressive stress. This additional compressive stress is equal to the quotient of the weight supported by the cable divided by the cross-sectional area of the beam.

Another important consideration when calculating the maximum loading of a beam is the vertical deflection of the beam when the beam is exposed to a load of weight "W". The vertical deflection will vary depending on the modulus of elasticity "E" of the material in a longitudinal direction along the beam and of the moment of inertia "I" of the cross-section of the beam. The vertical deflection "y" is typically expressed in terms of the following parameters: $y = k\ (W \times L^3)\ /\ (E \times I)$ where "k" is a constant. If the material has a high modulus of elasticity in a longitudinal direction along the beam, the deflection of the beam for a given load will be smaller. A smaller deflection, provides increased stability when the beam is loaded. Further, the ability of the beam to resist buckling is increased. This is especially important in the case of a thin walled beam which may be inherently prone to failure caused by buckling due to compression in the sides and bottom wall of the beam.

The thickness of each of the pre-molded plates 32, 34, 36 and 38 of the middle structural layer 30 can be varied, depending on design requirements. A thicker plate would of course provide more strength in tension and in compression. Typically, the plate that is to be on the bottom of the beam should be thicker than the plate on the top because the plate on the bottom is in compression and the compressive strength of such constructed plates is less than the tensile strength. The mass of the beam can also be minimized if the thickness of the plates is minimized.

Thinner plates are also desirable in order to reduce the amount of heat energy emitted by the exothermic reactions during the curing of the resins. If excessive heat is encountered during the curing, cracking of the resin can result. Further, thinner plates with higher glass content will shrink less during curing.

Reference will now be made to FIGS. 4 through 11 which show a method by which the beam is manufactured. A first mold portion 60, which is generally "U" shaped, is put in place with the opening of the "U" shape facing upwardly. A chopped strand mat 62 that has been soaked in resin, is placed in the first mold portion 60 such that the chopped strand mat 62 is in intimate contact with the inside surface of the first mold portion 60. A portion of the chopped strand mat 62 projects outwardly from each edge of the first mold portion 60 as can be best seen in Figure 5. The total amount of chopped strand mat projecting therefrom is preferably enough to span across the opening of the "U" shaped first mold portion.

Figure 6:
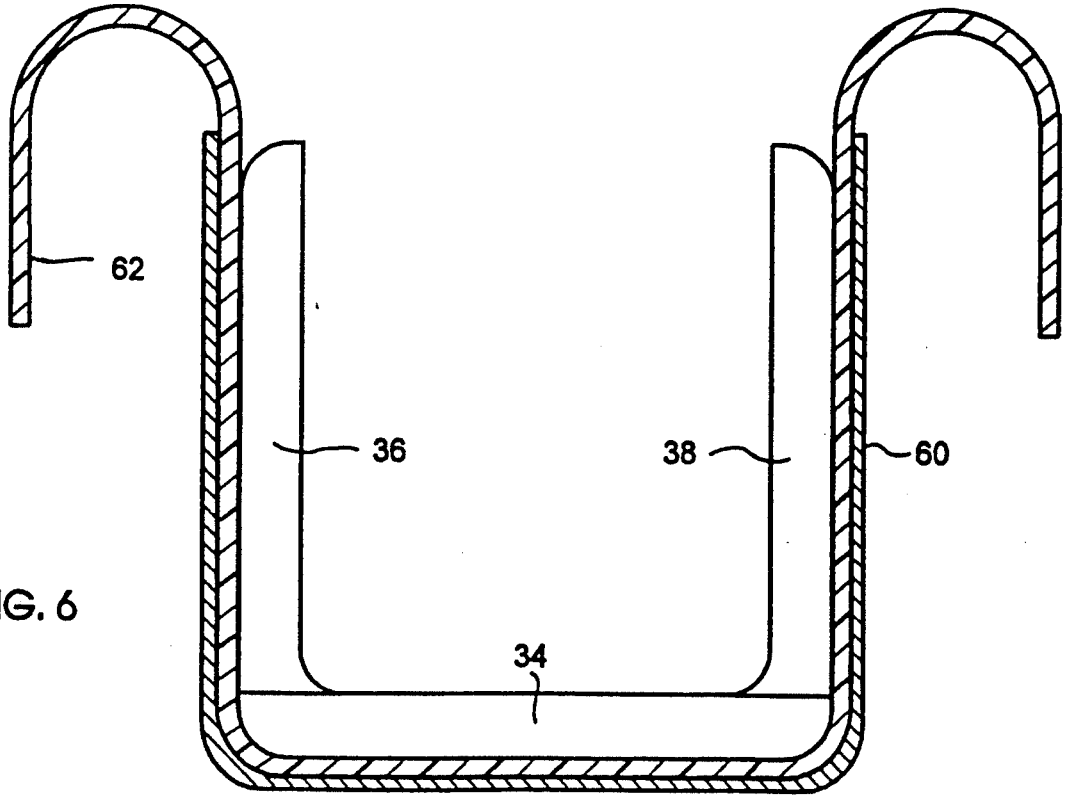
Figure 7:
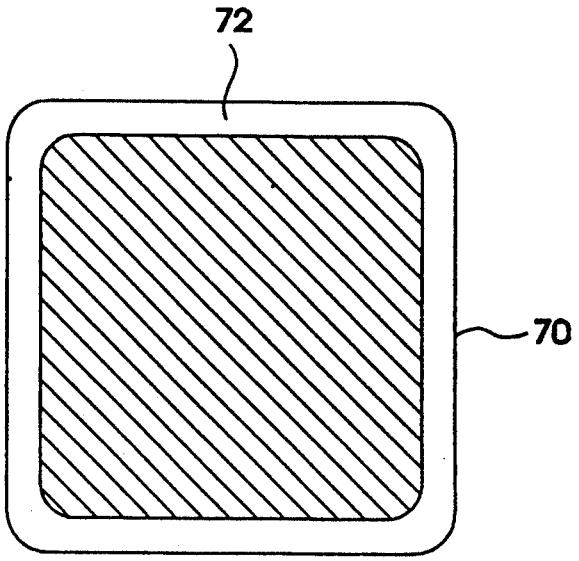
Figure 8:
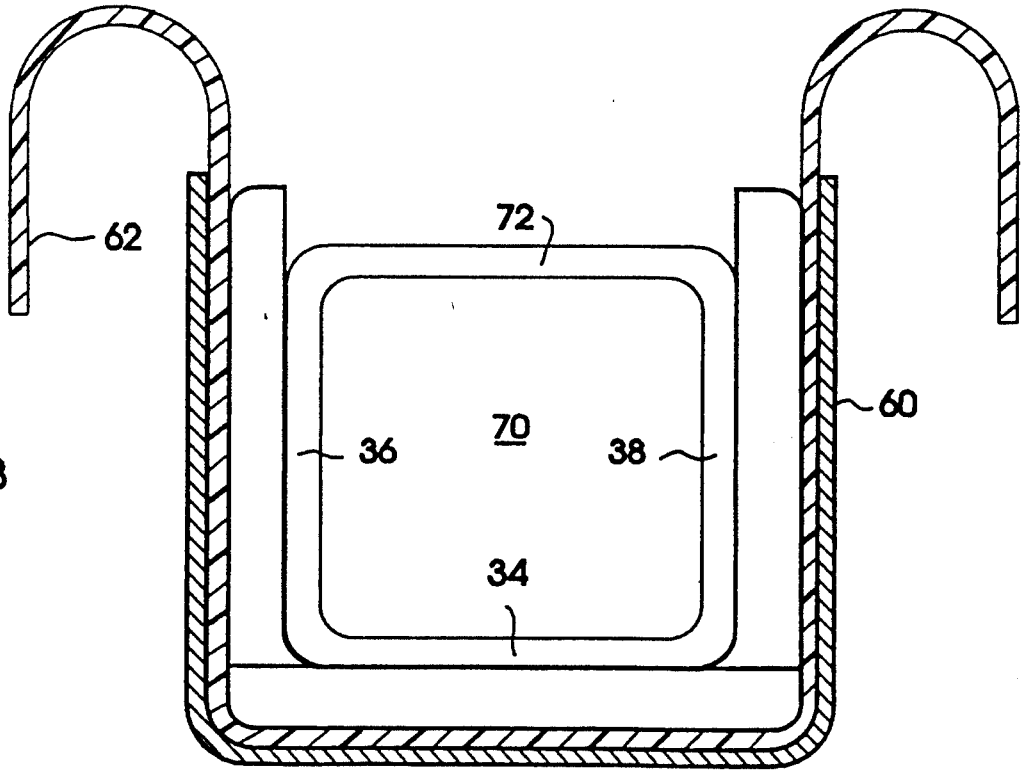
Figure 9:
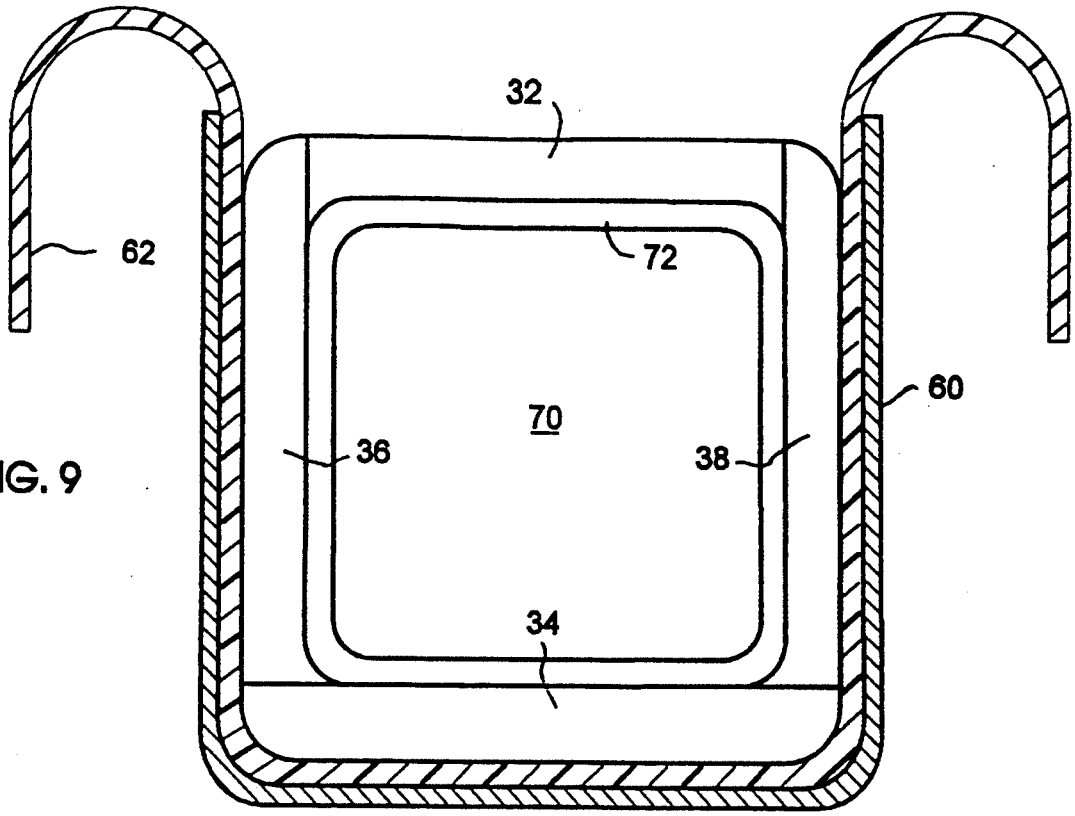
Figure 10:
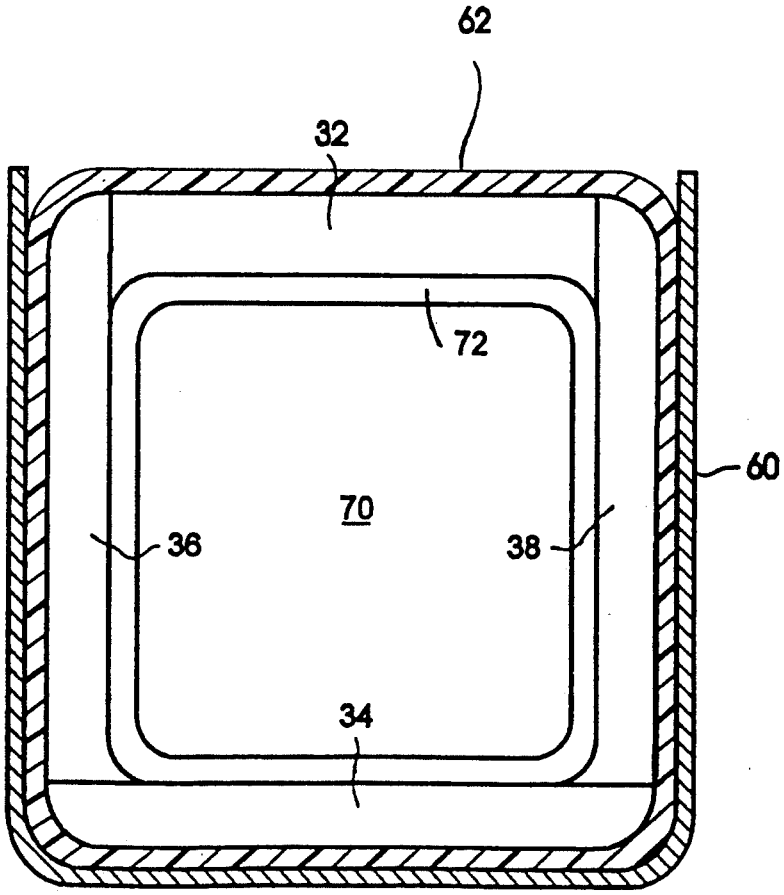
Figure 11:
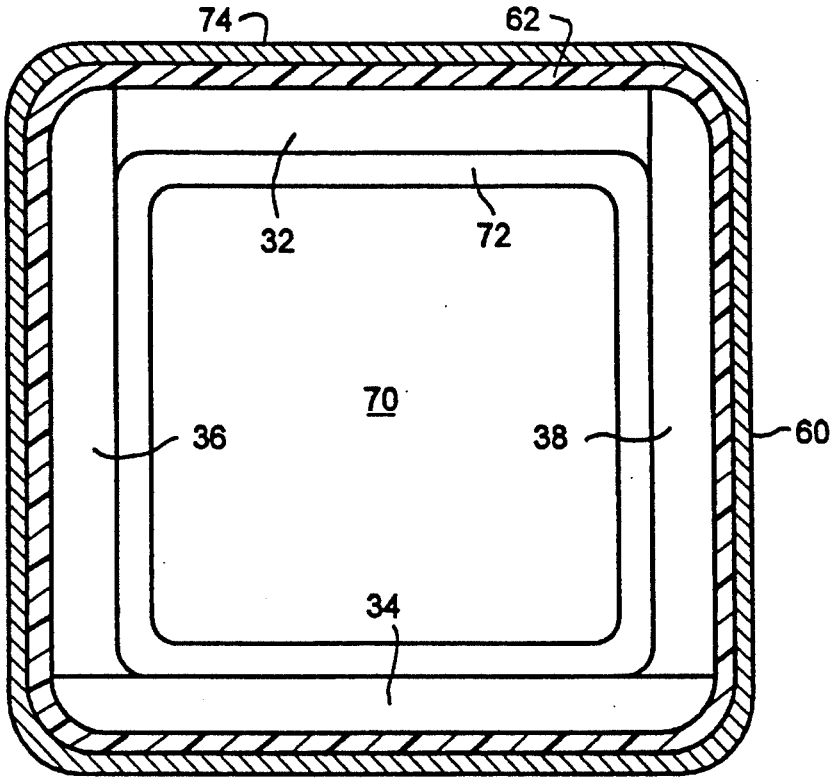

FIG. 6 shows that after the chopped strand mat 62 is in place, the second plate 34 is placed in the "U" shaped first mold portion 60 on top of the chopped strand mat 62. The second plate 34 lies on top of the resin filled chopped strand mat 62, with the distance between the second plate 34 and the inner surface of the first mold portion 60 defining the thickness of the bottom part of the inner structural layer.

The third and fourth plates 36, 38 are then placed in the first mold portion 60 such that the bottom edge of each is in intimate contact with the surface of second plate 34, and one side of each presses against the resin filled chopped strand mat 62. The distance between the outer surface of each of third and fourth plates 36, 38 and the inner surface of the first mold portion 60 defines the thickness of the sides of outer structurally layer 50.

The next step comprises taking a mandrel 70, which is in the shape of the hollow core 22 of the beam, and winding continuous filament 72 around the mandrel 70 in layers of continuous roving along the length thereof. The continuous filament 72 is first soaked in a quantity of resin, and then wound around the mandrel 70. The combination of the continuous filament 72 and the resin forms the inner structural layer 24.

The combination of the mandrel and the inner structural layer 24 formed therearound, are then placed into the "U" shaped mold 60 within the confines of the third and fourth plates 36, 38 and on top of the second plate 34. The resin which is as yet uncured and still in its liquid state. The first plate 32 is then placed on the inner structural layer 24. Any excess of resin in the inner structural layer escapes from underneath the first plate 32 through the interfaces between first plate 32 and third and fourth plates 36, 38.

The portions of the chopped strand mat 62 that were left protruding from the first mold portion 60 are then folded over the first plate 32. A second mold portion 74 is then placed over the entire assembly such that it spans across the opening of the "U" shaped first mold portion 60. The components of the beam are thus completely encased. Again, the resin flows to fill any voids, and any excess resin escapes between the interface between first mold portion 60 and second mold portion 74.

Pressure is applied to various portions of the two mold portions in order remove all entrained air and excessive resin. The resin is allowed to cure under this pressure. It is very important that there are no voids within the resin, in either the inner or outer structural layers, after the resin has cured. Voids, which are basically air pockets, may be present in the resin before curing, and are removed by putting pressure on the beam as the resin cures. Voids are very undesirable since they weaken the beam and can also allow water to intrude into the beam. If water intrudes into the beam, the beam becomes a much better conductor of electricity, thereby making it unsafe in the event of coming in contact with hydro wires.

After curing, the entire assembly is removed from the mold and the mandrel is removed from the beam by pulling it out longitudinally from the beam.

Figure 12:
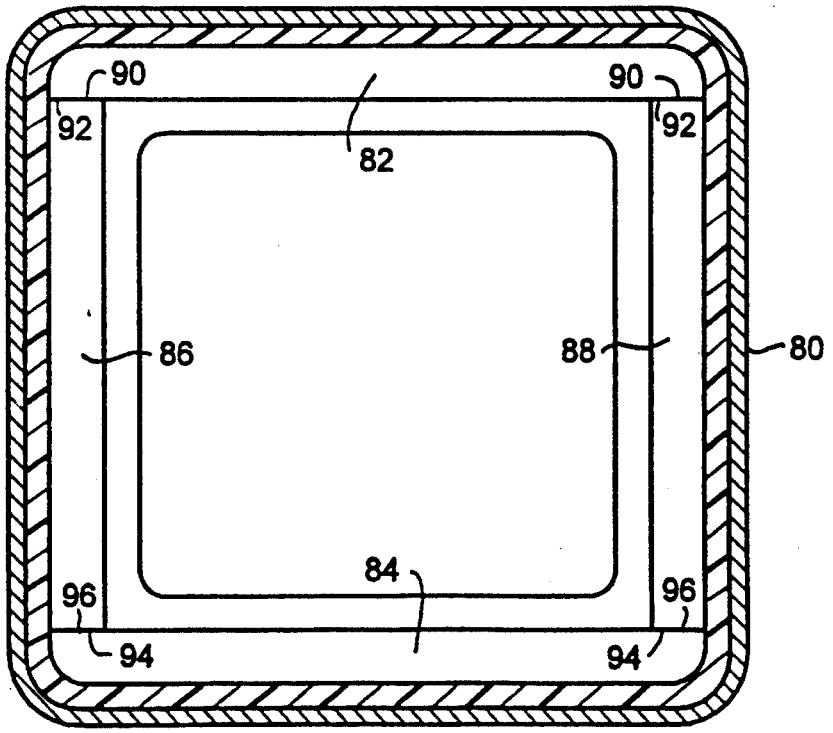
Figure 13:
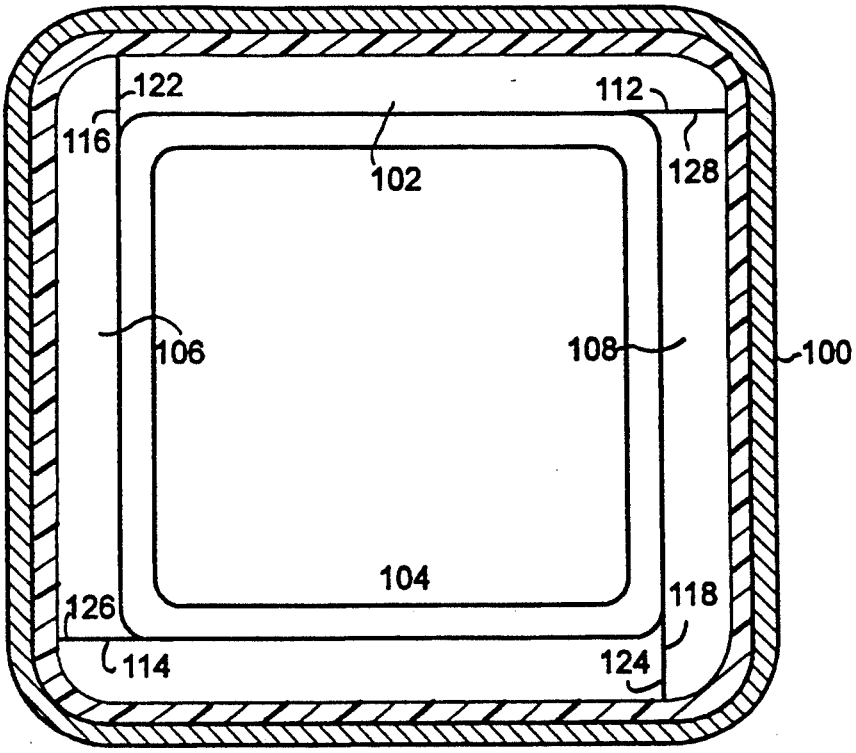

FIGS. 12 and 13 show alternative embodiments of the invention, in which the first, second, third and fourth plates are shown to have a slightly different configuration than the preferred embodiment.

In FIG. 12, portions of the sides 90 of the first plate 82 are in intimate contact with one edge 92 of each of third and fourth plates 86, 88. Similarly, portions of the side 94 of the second plate 84 are in intimate contact with the opposite edges 96 of the third and fourth plates 86, 88.

In FIG. 13, a portion of the sides 112, 114, 116 and 118 of each of the plates 102, 104, 106 and 108 is in intimate contact with the edges 128, 126, 122 and 124 correspondingly of an adjacent plate.

Figure 14:
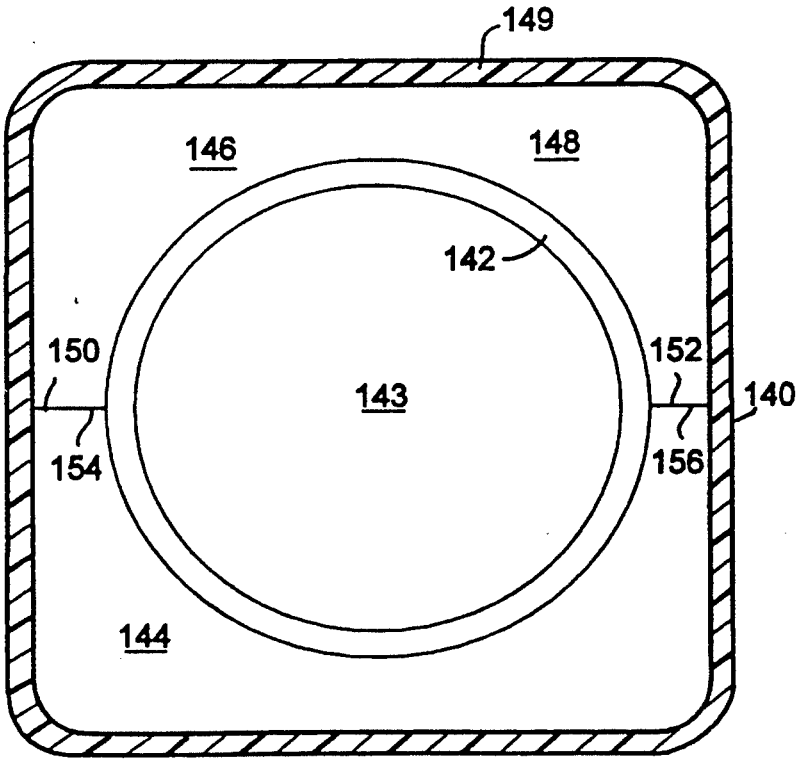
FIG. 14 shows an alternative embodiment of the invention.

Reference is now made to FIG. 14 which shows an alternative embodiment of the beam 140, having an inner structural layer 142 that is circular in cross-section. The inner structural layer 142 comprises a continuous filament wound in layers of continuous roving along the length of the beam 140, and defines a cylindrical hollow core 143. The middle structural layer 148 comprises a first plate 144 and a second plate 146 which are pre-molded and composed of a cured resin material having a fibre roving with the fibres being generally unidirectional and substantially aligned lengthwise along the plates. These two plates are generally "c"-shaped and have rounded inner surfaces so as to conform to the circular shape of the inner structural layer 142. The first plate 144 has edges 150 and 152 that are in intimate contact with corresponding edges 154 and 156 of the second plate 146. Around the outside of the middle structural layer 148 is the outer structural layer 149, which is the same configuration as the outer structural layer as described in the preferred embodiment.

In a further alternative embodiment, it is possible to make the plates 32, 34, 36 and 38 tapered such that they are thicker at one end of the beam and thinner at the other. This allows for the larger stresses typically found at the fixed end of the beam to be properly accommodated while the other end of the beam is lighter in weight yet sufficient strong to accommodate the lower stresses typically found in that part of the beam.

It is also contemplated that the beam of the present invention could be used as a lamp standard, or indeed in many other ways.

Other modifications and alterations may be used in the design and manufacture of the beam of the present invention without departing from the spirit and scope of the accompanying claims.

What is claimed is:

1. A high strength and light weight composite beam comprising:

a core running lengthwise along the beam;

three structural layers around said core including an inner structural layer, a middle structural layer and an outer structural layer;

wherein said inner structural layer comprises a glass filament winding in layers of continuous helically wound roving along the length thereof, said filament being encased within cured resin;

wherein said middle structural layer comprises four pre-molded plates, each plate having a first side and a second side, said plates being in contact with one another to form a hollow cross-sectional shape, and wherein said plates are placed around said inner structural layer such that one side of each plate is in contact and structurally bonded with said inner structural layer;

wherein each pre-molded plate is composed of a cured resin material having glass fibre roving, comprising a multiplicity of fibres said fibres being generally unidirectional and substantially aligned lengthwise along said beam;

wherein said outer structural layer comprises glass fibre material, said glass fibre material being wrapped around said plates along the length of said mandrel, and said material has been saturated with resin which has then been cured;

wherein the glass filament content of said composite beam is at least 70% of the weight thereof;

wherein said beam is manufactured so as to be free of voids within each of said layers and between said layers; and wherein said core is hollow.

2. The composite beam of claim 1, wherein said middle structural layer comprises four pre-molded plates, a first plate, a second plate, a third plate, and a fourth plate, each plate having a first edge, a second edge, a first side and a second side, wherein said edges of said first plate are in contact with a portion of the sides of said third and fourth plates, and wherein said edges of said second plate are in intimate contact with another portion of the sides of said third and fourth plates, wherein said four plates form a hollow cross-sectional shape, and wherein one side of each plate is in contact with said inner structural layer.

3. The composite beam of claim 2, wherein said four plates form a hollow rectangular cross-sectional shape.

4. The composite beam of claim 2, wherein said first plate forms the top of said composite beam, said second plate forms the bottom of said composite beam, said third plate forms a first side of said composite beam and said fourth plate forms a second side composite beam.

5. The composite beam of claim 1, wherein said outer structural layer is a material that is woven.

6. The-composite beam of claim 1, wherein said outer structural layer is a reinforcing fibrous material that is non-woven.

7. The composite beam of claim 1, wherein said fibres found in each of said pre-molded plates are oriented in both longitudinal and lateral directions.

8. The composite beam of claim 1, wherein said glass filament is a multi-strand filament.

9. The composite beam of claim 1, wherein said beam has an high dielectric strength.

10. The composite beam of claim 9, wherein said beam allows a current flow in the order of a few microamperes when exposed to an electrical potential of about 100,000 volts.

* * * * *